US008289161B2

(12) United States Patent
Hosey

(10) Patent No.: US 8,289,161 B2
(45) **Date of Patent: *Oct. 16, 2012**

(54) INEXPENSIVE MASS MARKET ALARM SYSTEM WITH ALARM MONITORING AND REPORTING

(75) Inventor: Mark Hosey, South Lanarkshire (GB)

(73) Assignee: Honeywell International Inc., Morristown, NJ (US)

( * ) Notice: Subject to any disclaimer, the term of this patent is extended or adjusted under 35 U.S.C. 154(b) by 1174 days.

This patent is subject to a terminal disclaimer.

(21) Appl. No.: 12/130,200

(22) Filed: May 30, 2008

(65) Prior Publication Data

US 2009/0295571 A1 Dec. 3, 2009

(51) Int. Cl.
*G08B 13/00* (2006.01)

(52) U.S. Cl. ..... 340/541; 340/540; 340/565

(58) Field of Classification Search ..... 340/540, 340/541, 506, 286.01, 286.02, 545.1, 546, 340/521, 565; 705/1, 7, 10
See application file for complete search history.

(56) References Cited

U.S. PATENT DOCUMENTS

| | | | | |
|---|---|---|---|---|
| 6,741,171 | B2 * | 5/2004 | Palka et al. | 340/501 |
| 7,085,551 | B1 | 8/2006 | Bonner et al. | |
| 7,825,792 | B2 * | 11/2010 | Buehler | 340/506 |
| 2008/0122575 | A1 * | 5/2008 | Lavian et al. | 340/3.1 |

FOREIGN PATENT DOCUMENTS

WO WO 2008/041214 4/2008

OTHER PUBLICATIONS

European Patent Office Search Report, mailed Jun. 7, 2009 corresponding to International application No. 09161133.5-1232.
Cisco Systems: "Alarm Interface Controller Network Module for the Cisco 2600 and 3600 Series" Datasheet Cisco, Jan. 1, 2005, pp. 1-13, XP007908965.

* cited by examiner

*Primary Examiner* — Anh V La
(74) *Attorney, Agent, or Firm* — Husch Blackwell LLP

(57) ABSTRACT

A monitoring system includes a plurality of sites being monitored for predetermined events. One or more sensor at each site detect at least one predetermined event in a specified area. One or more communications modules at each site communicate with the sensor and transmit an alert signal of the event using a communications system. The communications module(s) communicates with the sensor, and the communications module transmits the alert signal of the event using a communications system. A remotely located computer system communicates with the communications module using the communications system. The computer system logically divides and presents on a display data about the sites being monitored. The computer system controls the communications between the communications module and the computer system for receiving transmissions from, and sending transmissions to, the communications module. The computer system communicates an alarm signal after receiving the alert signal.

11 Claims, 2 Drawing Sheets

INEXPENSIVE MASS MARKET ALARM SYSTEM WITH ALARM MONITORING AND REPORTING

CROSS REFERENCE TO RELATED APPLICATION

This application is related to commonly-owned, U.S. patent application Ser. No. 12/125,529 filed on May 22, 2008, the entire contents and disclosure of which is expressly incorporated by reference in its entirety.

FIELD OF THE INVENTION

The present invention relates to a monitoring system and method for remotely monitoring a specified area, and more particularly, a monitoring system and a method including a computer system for remotely monitoring a specified area.

BACKGROUND OF THE INVENTION

Typical security systems or alarm systems are expensive to buy, install and maintain. Approved alarm systems, whose installation meets the requirements of the security industry and required by insurance companies, generally require skilled personnel to install and maintain them. Thus, alarm systems often require a high level of expertise to install and commission. Additionally, the installation process of setting up communications between all the system devices, detectors, and configuring each of the devices to function correctly requires a depth of knowledge about alarm systems which may be beyond the skill of the average homeowner. Moreover, installation and user manuals are often extensive and complex and even simple changes to a systems configuration can require an installation engineer's or technician's expertise. For these and other reasons, many homeowners find the costs incurred for installing and maintaining a security system, and alarm monitoring and reporting services prohibitively high. As a result, many homes do not have any alarm system, and further, those with alarm system may be inadequately maintained due to high maintenance costs.

Typical currently known security systems generally include an on site control device such as a control panel. The control panel may include a microprocessor with software or firmware designed for monitoring one or more sensors designated to specified areas. The sensors may be divided into security zones which are all monitored by the central control panel. The control panel is a significant cost of the security system. The security system, including the control panel, requires installation, inspections, maintenance, repairs, and upgrades. The control panel hardware can be expensive and the installation requires the time of a skilled technician. Further, when updating the software or firmware, a technician has to visit the site where the security system and control panel are located, which is costly and time consuming. Additionally, it is possible that upgrading the security system requires additional hardware or changing hardware to enable new features or functions, which can be costly and require the time of a skilled technician. Further, a supplier and/or warehouse may have to stock large quantities of various panel types to meet demand, thus incurring cost.

Another problem with current security systems is the cost to a manufacturer to make and store components of a typical security or alarm system, such as a control panel, and key pads for entry/exit points, as well as, sensors and actuators for activating electronic locks, door locks, bells, strobes, and valves, etc. Further, the continued cost for alarm monitoring and reporting services may be prohibitively high for many homeowners.

It would therefore be desirable to reduce the need for technical personnel, e.g., to install, monitor, inspect, repair, and upgrade on site control devices or control panels of security systems. It would also be desirable to have a security system or method which did not require the installation of a control panel. It would further be desirable for the control device or control panel of the security system to be located remotely and require low installation costs. Additionally, a need exists for a central control device which can monitor a multitude of security systems. Further, it would be advantageous to provide a security system which is easier for a user to configure.

SUMMARY OF TUE INVENTION

In an aspect of the invention, a monitoring system includes a plurality of sites being monitored for predetermined events which may include security events. One or more sensors at each site detect the predetermined event in a specified area. At least one communications module at each site communicates with the sensor and transmits an alert signal of the event using a communications system. At least one communications module includes a transceiver. The communications module communicates with the sensor, and the communications module transmits the alert signal of the event using a communications system. A remotely located computer system communicates with the communications module using the communications system. The computer system logically divides and presents data about the sites being monitored. The computer system receives the alert signal and the computer system controlling the communications between the transmitting device of the communications module and the computer system for receiving transmissions from and sending transmissions to the communications module. The computer system communicates an alarm signal after receiving the alert signal.

In a related aspect, the computer system communicates with multiple communication systems for communicating with associated communication modules. Further, the computer system may communicate with multiple communication systems for receiving the alert signal from the communications module and for transmitting to the communications module. The computer system may communicate simultaneously with multiple communication systems for receiving the alert signal from associated communication modules using each of the multiple communication paths, and the computer system may use each of the multiple communication systems for transmitting to each of the associated communication modules. The communication module may communicate with a plurality of security areas in a site and each security area may include a plurality of sensor devices. Further, the computer system may include a computer program embodied on computer readable medium executable by a microprocessor in the computer system, and the computer program may logically generate security zones within a site, and each security zone may include a plurality of associated sensor devices. The system may further include an interface connected to the communications module for a user to interface with the computer system. The system may further include actuators connected to the communications module. The actuators may actuate devices to indicate an alarm condition and/or to switch on or off functional devices of the alarm system. The system may further include multiple communication modules, and the multiple communication modules may each connect to a data bus communicating with security areas including multiple sensors and/or actuators. The communications module and sensors may communicate wirelessly. Further, the transmission of the alert signal may be encrypted. The system may further include an on-site interface at a site, the on-site interface communicating with the computer system for a user to receive data about the sensor on the on-site interface. The alarm signal may be transmitted to the respective communications module which actuates an alarm.

In another aspect of the invention, a method for monitoring a specified area comprises: detecting predetermined events using sensors at a plurality of sites; communicating with the sensors using a communications module at each site, the communications module transmitting an alert signal of the event using a communications system; receiving the alert signal using a remotely located computer system communicating with the communications module; dividing logically and presenting data about the sites being monitored; controlling the communications between the transmitting device of the communications module and the computer system for receiving transmissions from and sending transmissions to the communications module; and communicating an alarm signal using the computer system after receiving the alert signal.

The method may further include communicating simultaneously with multiple communication systems using the computer system. The method may further include generating logically a plurality of security zones each associated with a plurality of sensor devices using the computer system. Further, the method may include providing an on-site interface for a user to send and receive data from the computer system for selecting configuration preferences for the sensor and an on-site security system.

In another aspect of the invention, a computer program product comprises a computer readable medium having recorded thereon a computer program for enabling a processor in a computer system for monitoring a specified area, the computer program performing the steps of: detecting predetermined events using sensors at a plurality of sites; communicating with the sensors using a communications module at each site, the communications module transmitting an alert signal of the event using a communications system; receiving the alert signal using a remotely located computer system communicating with the communications module; dividing logically and presenting data about the sites being monitored; controlling the communications between the transmitting device of the communications module and the computer system for receiving transmissions from and sending transmissions to the communications module; and communicating an alarm signal using the computer system after receiving the alert signal.

BRIEF DESCRIPTION OF THE DRAWINGS

These and other objects, features and advantages of the present invention will become apparent from the following detailed description of illustrative embodiments thereof, which is to be read in connection with the accompanying drawings, in which.

DETAILED DESCRIPTION OF THE INVENTION

Figure 1:
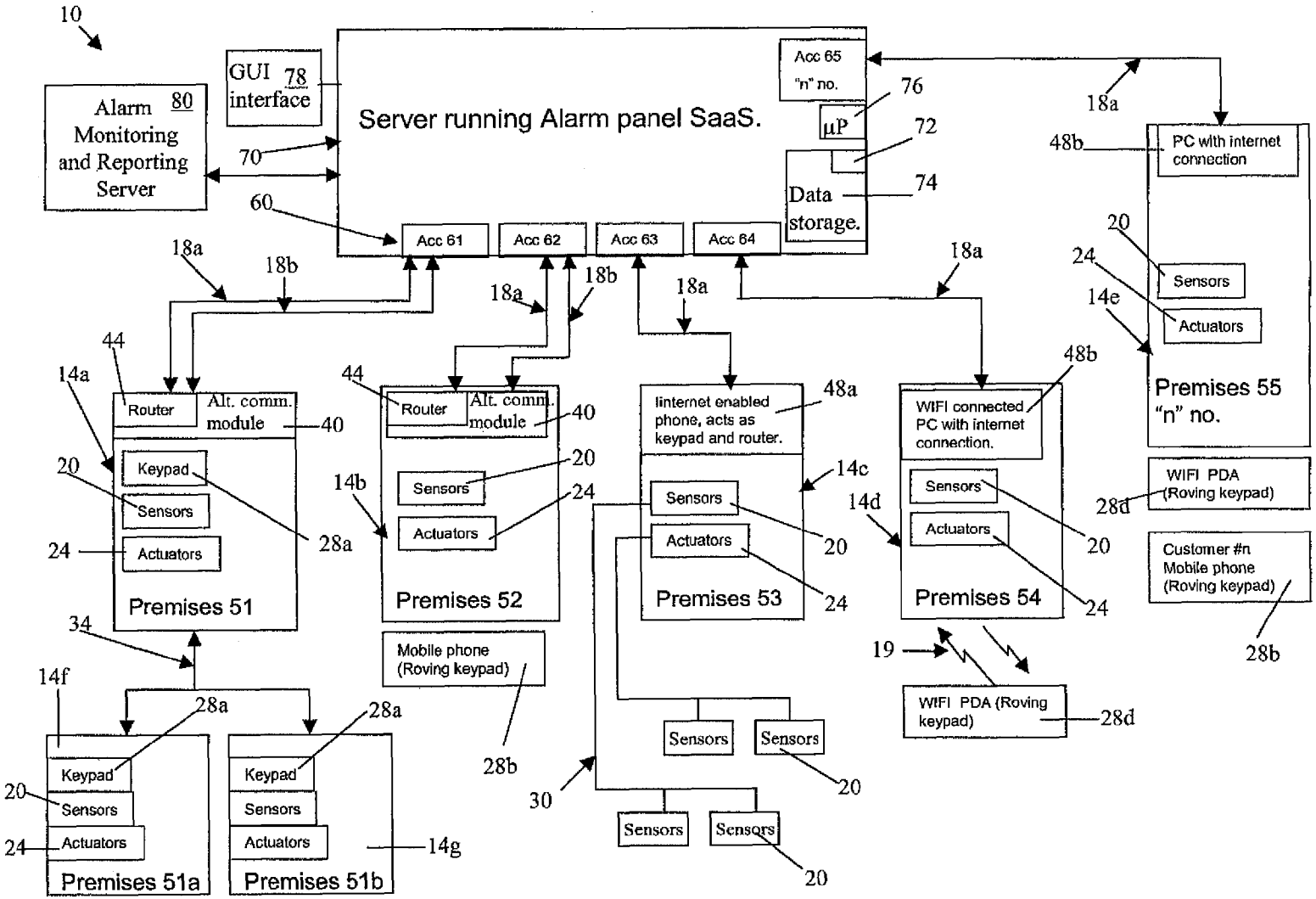
FIG. 1 is a block diagram depicting a monitoring system according to an embodiment of the present invention including sensors capable of transmitting an alert signal, and a communications module transmits an alert message to a computer system using a communications system.

An illustrative embodiment of a monitoring system and method of monitoring embodied is shown in FIG. 1 as a security system 10 and method of securing one or more specified areas at each of a plurality of sites 14*a*, 14*b*, 14*c*, 14*d*, 14*e*, 14*f*, 14*g*. The sites 14*a*-14*g* are embodied as residences or premises 50-55, respectively, where premises 55 represents an "n" number of possible premises. The sites are monitored for predetermined events, which include, for example, security, e.g., burglary, fire, carbon monoxide. Alternatively, the sites may be monitored for a host of other objectives, for example, statistical analysis, and by video cameras or other detection devices for a particular purpose. The system 10 includes one or more sensors 20 for detecting the event and monitoring the specified areas at the sites 14*a*-14*e*. The sites 14*a*-14*e* may be residence or premises as shown in premises 51-55, or in alternative embodiments, the site may include, a commercial building(s) or a campus including buildings. Additionally, the premises 51 includes separate areas or zones 51*a*, 51*b* connected by an intranet 34. The separate areas 51*a*, 51*b* both include sensors 20 and actuators 24 and communicate with the communication module 40 using the intranet 34.

The actuators 24 indicate an alarm conditions, system faults or switch on and/or off devices associated with the functioning of an alarm system. For example, for a gas alarm, an actuator may be used to close valves and switch on a ventilation system, for a system with access control a device for allowing ingress and egress, for a fire alarm system a device for switching on emergency lighting.

The sensors 20 each transmit an alert signal to a communications module which, for example, may be embodied as a router 44, an Internet enabled phone 48*a*, or an internet connected computer, or other communications modules 40 capable of communicating with the computer system or server running the alarm panel SaaS. The event may include an emergency event, e.g., a fire, flood, or burglary which may include detection of designated sounds, glass break, or entrance into a specified area. Further, the sensors 20 included in the system 10 may include, smoke detectors, fire detectors, motion detectors and/or infrared (PIR) detectors indicating a burglary attempt. Actuators 24 communicate with the communications modules 40, 44, 48*a*, 48*b* for receiving authorization for activating electronic locks, door locks, bells, strobes, and valves, etc. The actuators communicate by the same means as the sensors, with a central Internet based alarm control facility embodied as the computer system 70, shown in FIG. 1.

The sensors 20 may be grouped in specified areas of the sites 14*a*-14*g*, however, alternatively, the sensors 20 may be individually positioned in one or more areas, building, or floors of a building or located throughout a campus. The sensors 20 and actuators 24 may communicate with an expander module (not shown) which allows for expansion or scalability of the security system to interface with multiple sensors 20 and actuators 24 and multiple types or kinds of sensors and actuators. Additionally, other modules (not shown) may be used for additionally security devices such as door control, audio detection, or video monitoring within a site 14*a*-14*g*. The sensors 20 and actuators 24 transmit data along a data bus 30 and data bus 30, shown connecting the sensors 20 and actuators 24 of premises 53. Alternatively, multiple sensors 20 may communicate with the communications module 40 using wireless technology. User interfaces may be embodied as a keypad 28*a*, or alternatively, a mobile phone 28*b* having a keypad, or a WIFI connected Internet enabled phone 48*a* as an embodiment of a communications module which includes a keypad, or a WIFI connected 19 handheld computer 28*d* (or PDA) having a keyboard and a display and having an Internet connection as shown in premises 54. The WIFI connection 19 may use, for example, Bluetooth® or other wireless technology.

The communications modules may include a router 44, an Internet connected telephone 48*a*, or Internet connected computer (i.e., one fitted with a modem) 48*b*, as embodiments of different communication devices. Each communication module 40, 44, 48*a*, 48*b* includes a transceiver device for communicating with the sensors 20 and transmitting an alert signal via one or more communication systems, in the present embodiment, redundant communication systems 18*a*, 18*b*, for example, the Internet using a router 44, or Internet enabled telephone 48*a* or computer with Internet connection 48*b*, indicating a security or emergency event to a remotely located computer system 70. In one embodiment, all the devices on the protected premises (e.g., sensors 20, actuators 24) communicate with the communications module 40 using wireless technology (WIFI, Bluetooth®, etc.) as the technology provides an easy means of installation, however, wired devices may also be used in alternative embodiments.

The computer system 70 may be, for example, a server with peripheral devices such as a monitor, external hard drives, or a network of servers. The computer system 70 includes a computer program 72 saved in a data storage device 74 and a microprocessor 76 for executing the computer program 72. The computer system 70 communicates with the router 44, Internet enabled (3G) phone 48*a*, Internet connected PC 48*b*, and any other alternative communications modules 40 using one or more communications systems, for example, Internet based communication systems 18*a*, and/or alternative communication systems, which may include public switched telephone network (PSTN), and another alternative communication module uses, for example, General Packet Radio Service (GPRS) which is a mobile data service using Global System for Mobile Communications (GSM).

The computer system 70 logically divides the sites being monitored. In the present embodiment, the computer system 70 presents on a display embodied as a graphical user interface (GUI) interface 78 the sites being monitored. Alternatively, the computer system 70 may make alarm system information and data available to a service provider having an alarm monitoring and reporting server 80. Further, the alarm system information and data can be arranged for the information and data to be relayed to computers or servers owned by the alarm monitoring service provider. The computer system receives the alert signal via the communications systems and the computer system controls the communications between the transmitting devices of the router 44, Internet connected phone 48*a*, Internet or Intranet connected PC 48*b* and alternative communications module 40 and the computer system 70 for receiving transmissions from and sending transmissions to the communications modules. The computer system 70 communicates an alarm signal to the alarm monitoring server 80 after receiving the alert signal from the communications modules 40, 48*a*, 48*b*.

One or more communications modules 30 are located at each site 14*a*-14*g*. Each of the communications module 40, 44, 48*a*, 48*b* include a transmitting device. The communications modules communicate with the sensor, and the communications modules transmit the alert signal of the event using a communications system. The communications modules 40, 48*a*, 48*b* may include a router 44 or a wireless communicating (WIFI) device communicating with the sensor 20. The communications module 40, 48*a*, 48*b* transmits an alert signal of the event using a communications system 18*a*, 18*b*.

More specifically, the communications modules 40, 44, 48*a*, 48*b* use different modes of communication and offer redundancy of the transmission of alert signals, e.g., if one mode fails, the alarm signal would reach the computer system 70 using another mode of communication from another communications module. The redundant communications can be sent, for example, simultaneously or upon failure of one or more of the communication modules. Many modes or types of communication may be used in the communications module, in the embodiment of the invention shown in the FIG. 1, an Internet based communications mode using communication modules 48*a*, 48*b* uses, for example, Ethernet standards or protocols on a computer network, alternative communication modules 42 uses. The computer system may also communicate simultaneously with multiple communication systems for receiving the alert signal from associated communication modules using each of the multiple communication paths, as well as, simultaneously sending or transmitting to each of the associated communication modules.

The remotely located computer system 70 monitors and responds to the communications of the transmitting devices of the communications modules 40, 44, 48*a*, 48*b* which monitor and respond to the sensor devices 20. The computer system 70 communicates an alarm signal, for example, upon receiving an alert signal via the communications systems, or after an analysis of the type and/or frequency of the alert signal. The computer system 70 may also have multiple microprocessors and other back up systems or have a back up for the entire computer system 70. The computer system 70 may be located at a monitoring station or a central station, and/or send alarm signals to portable or hand held device, such as cellular telephones, as well as emergency personnel. The alarm monitoring and reporting service 80 may share all or part of the hardware resources used by the Alarm panel SaaS 70, whereby the alarm panel 70 is capable of carrying out simple automatic reporting. However for alarm confirmation services where the service provider must rely on staff to view video data or listen to audio data, the server running the SaaS will make the data available either locally on a GUI or remotely on GUIs connected to the separate monitoring server 80.

Other communications modes and alternative system components may be employed. For example, as shown in commonly-owned, and co-pending U.S. patent application Ser. Nos. (12/125,529) and (12/015,679), the entire contents and disclosures of both of which are expressly incorporated by reference herein in their entirety.

Referring to FIG. 1, Internet connected mobile phones configured as alarm system keypads can communicate with the server over their own link and need not communicate via the system router. Suitably equipped mobile phones can be configured as routers and system keypads. However, if there is no alternative Internet communicating devices on the premises the mobile phone acting as the systems only Internet connection must remain on site when the alarm panel is set.

Multiple mobile phones or a personal digital assistant (PDA) (or handheld computer) can be configured on the system. Each is assigned a security authorization level allowing limited control of the alarm system, e.g., unrecognised phones have no system access rights. Particular phones can be assigned administrator privileges and will have authority to change a systems configuration. Customer keypads, sensors and actuators can communicate with the Internet connecting devices (router, phone, PC, etc) by a combination of any means acceptable to the device employed (for example, discrete wiring, WIFI link, blue tooth, etc).

Moreover, the computer system 60 includes a computer program 62 embodied on a computer readable medium, e.g., the data storage device 64 and executable by a microprocessor 66 in the computer system 60. In one embodiment of the invention, the computer program 62 logically generates a plurality of control devices or control panels, or divides the sensors being monitored into logical security zones. The control panels as well as the security zones may be graphically represented on a graphical user interface (GUI) 68. Additionally, the sensors 30 may be grouped into zones defined by the type of detection, including, for example, security zones, maintenance zones, or detection zones, and in further avatars, all smoke detectors may be in one zone and motion detectors in another zone.

The computer system may also remotely update software and/or firmware in communications modules 40, 44, 48*a*, 48*b* by sending a data transmission via communications systems 18*a*, 18*b* from the computer system 70 to the communications modules 40, 44, 48*a*, 48*b*. Thereby, centralized installation and upgrades of the computer system replaces the on-site control panel in current security systems, rendering technician visits to the site unnecessary in many instances. A further advantage of the security system of the present invention is that the computer system requirements include software and peripheral devices which are less expensive than an on site control panel. The costs savings applies to, for example, installation costs, e.g., unit cost and labor time, and upgrades, as well as, the cost saving of stocking and supply the software and peripheral devices as compared to control panels in conventional security systems. The communications modules and the computer system may also utilize encryption technology for sending and receiving signals.

Additionally, the computer system 70 monitors a plurality of separate on-site 14*a*-14*g* security systems, which may belong to different customers, in on-line accounts 60 wherein account 61 relates to premises 51, and accounts 62, 63, 64, and 65, relate to premises 52-55, respectively. The computer system 70 logically separates each of the security systems related to each site 14*a*-14*g*. The computer system 70 may provide a virtual presentation of the security system for each site 14*a*-14*g* to a systems coordinator and/or the premises 51-55 owner. The virtual presentation may include, for example, account information, as well as, status, maintenance, error messages for the system or individual sensors. For example, an embodiment of a virtual presentation may be a virtual control panel visual similar and functioning or performing like an on-site control panel. Other embodiments of virtual presentations may include a virtual control panel presented to a systems coordinator at a remote location monitoring the plurality of security system on site 14*a*-14*g* via the computer system 70, and other user friendly virtual management displays for the owners of the premises 51-55.

More specifically, the computer system may include using a computer program to generate a user friendly monitoring program presented to a user on an interface on-site for set-up, maintenance, troubleshooting, or choosing preferences for a security system or computer program. The interface could include, for example, a cell phone, telephone system, personal computer with a monitor. Using a personal computer, a website would allow prospective clients to choose, apply and pay for alarm protection contracts which meet their exact needs. This could include a pay as you go service. The website can allow a client to register all of their newly purchased alarm devices on their service provider alarm configured system (SPACS), and allow the client to configure all of the alarm devices. The website may provide an active configuration help service or wizard which prompts the client to configure their system. For instance, the active configuration may prompt the client to configure entry and exit devices and times. It should also provide an active glossary allowing clients to click on key words to get their meaning which the client may need to understand to configure the system correctly. Also, the website may provide a simple means of testing the system and an unequivocal means of identifying that a system is active, fully functional or in test mode. Further, the website can provide an easy means to add or remove components from a system. The website may further provide a secure means of communication for the client with possibly dual key encryption and password protection unique for each client.

Figure 2:
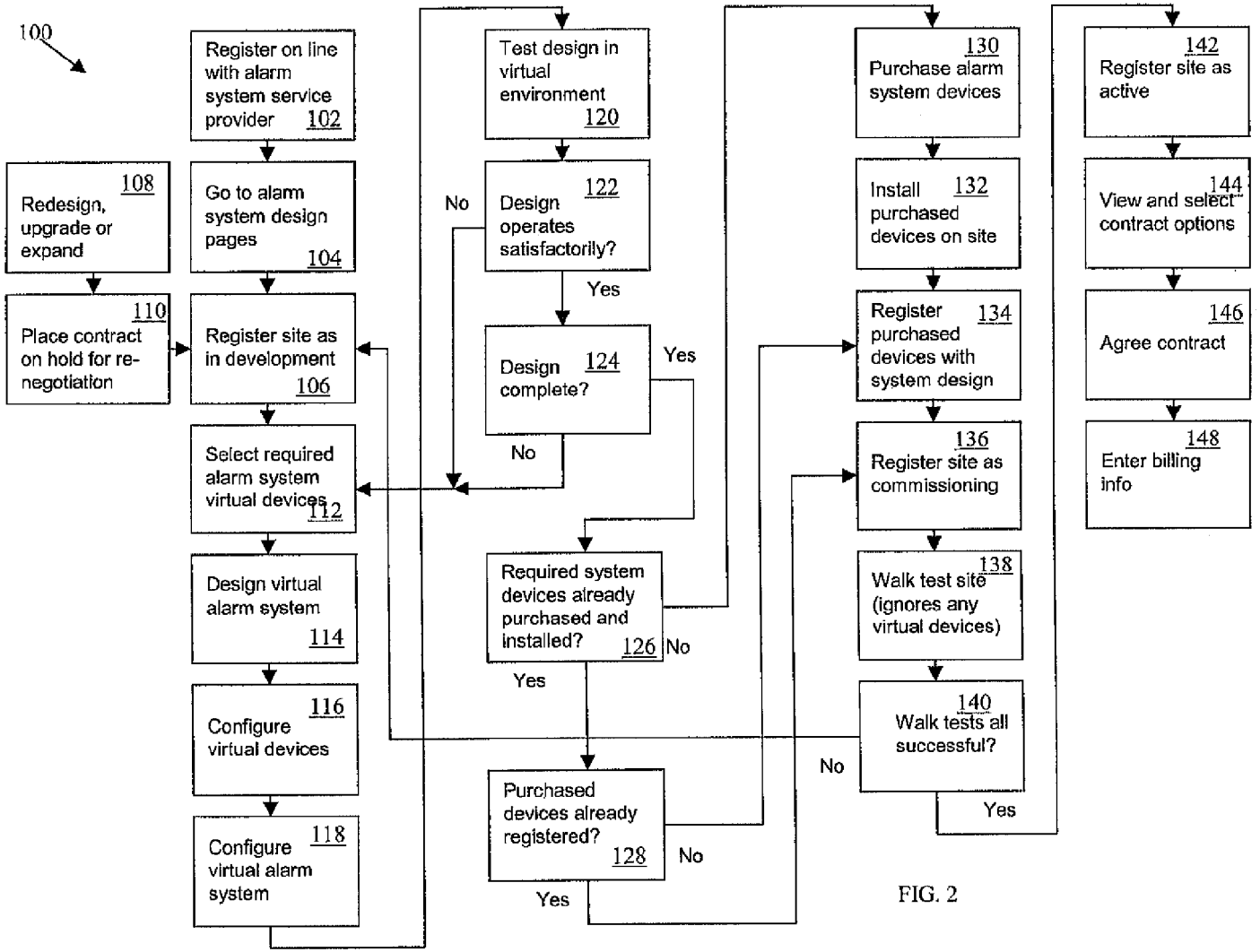
FIG. 2 is a flow chart depicting the steps of a method according to an embodiment of the invention and correlating with the monitoring system shown in FIG. 1.

Referring to FIG. 2, a flow chart of an embodiment of the present invention 100 is shown including the steps of, a user or client registering on line with an alarm system service provider 102 for a security or monitoring system 10 as shown in FIG. 1. The user navigates on a web page to alarm system design pages 104. The user registers the site (security site, e.g., premises) as in development 106. Alternatively, the user with an existing registered site (on line alarm system) may redesign, upgrade, or expand 108 the security or monitoring system 10 as shown in FIG. 1. The existing users contract is placed on hold for re-negotiation after the configuration modifications are presented 110, and the user register the existing site as in development 106. Next, the user selects required alarm system crucial device 112. The user designs the system virtually to ascertain, for example, price, and adequacy 114. The user then configures the virtual devices 116, and configures the virtual alarm system 118. The virtual design is tested in a virtual environment 120. If the design operates satisfactorily 122, the process continues to asking if the design is complete 124. If the design does not operate satisfactorily 122, the process returns to step 112 to select alarm system devices to correct the problem. If the design is complete 124, the process continues to ask if the required system devices are already purchased and installed 126. If the design is not complete 124, the process returns to step 112 to select more alarm system devices. If the required system devises are purchased 126, the next step is to ask if the devices are already registered 128. If the required systems devices are not purchased and installed 126, the next step is to go to step 130 for purchasing alarm system devices and step 132 to install the devices on-site 132. If the purchased devices are registered the next step is to register the site as commissioning 136. If the devices are not registered 128, the next step is to register the devices with the system design 134. A walk test is performed 138 at the test site. If the walk test is successful 140 the process continues at step 142 to register the site as active 142. If the walk test is unsuccessful 140, the process returns to step 106 to register the site as in development. The next step in the process is to view and select a contract and contract options 144. Once the user agrees with the contract 146, the user enter their billing information 148.

Generally referring to FIG. 1, in one embodiment of the invention, the monitoring system including all sensors, actuators, alarm system devices (including any required or accessory components) and Internet connected devices (ICTDs) employ blue tooth, infrared, WIFI or other wireless means of site communications (communications between devices on the protected premises). The wireless devices provide ease of installation, alone or in combination with hard wired components of a security system. Providing power for all sensors, actuators, alarm system devices/components and ICTDs is provided by power supply components which are acceptable by regulatory authorities and standards (e.g., hard wired with battery backup, battery or fuel cell powered with presence reporting and monitoring, near field/inductive power source with battery backup, etc). Each alarm system device has a unique address which will identify it to a remote Internet based service provider implementing and monitoring the computer system. All alarm system devices on the protected site are capable of communicating with the Internet based alarm system control, monitoring and reporting service provider via suitably equipped Internet connected devices.

In particular, all hardware alarm devices on the protected site must be capable of reporting their status to the alarm service provider at regular intervals. The alarm service provider must be capable of actively communicating with system components when required, for example, if a device has timed out on its status report. The alarm service provider must of course react in a timely fashion with appropriate responses to changes in alarm device status by reporting malfunctions, losses of communications, alarm conditions, etc. The service provider implementing the computer system 70, in the present embodiment, implements a secure website or websites that will provide alarm control, monitoring and reporting. The website allows prospective clients to choose, apply and pay for alarm protection contracts which meet their exact needs. The website allows a client to register all of their newly purchased alarm devices on their alarm service provider account. The website allows the client to configure all of the alarm devices on their alarm service provider account. The website provides an active configuration help service or wizard which prompts the client to configure their system. For instance, the website will prompt the client to configure entry and exit devices and times. The website also provides an active glossary allowing clients to click on key words to get their meaning which the client may need to understand to be able to configure the system correctly. The website further provides a simple means of testing the alarm system registered to the customers account and an unequivocal means of identifying the status of the system (e.g., active, fully functional, in test mode, in development, etc.). The website further provide an easy means to add or remove components from a system. The website provides a secure means of communication for the client, e.g., encryption and password protection unique for each client.

Thus, the security system according to the invention includes sensors, actuators and appropriate telephonic equipment in conjunction with appropriate Internet based services can provide an inexpensive fully monitored alarm system which is simple to install and meets all alarm industry standards. All the alarm system devices on the protected site requiring software configuration are be capable of being configured (within and using software) by the installer/customer via the Internet based alarm system control, monitoring and reporting service website. Thereby, the Internet based alarm control of the present invention, and monitoring and reporting service is capable of providing its customers with an inexpensive means of customizing their alarm system to provide property protection, as and when required, without necessarily requiring the aid of a skilled installation technician. Further, the security system of the present invention allows customers to tailor their alarm system to suit their requirements on a daily basis.

In operation, the security system of the present invention includes accessing the World Wide Web (Web) via the Internet to access a Web based alarm control computer system 70 including monitoring and reporting station. The Web based alarm control continually monitors the status of all devices on the protected premises and will report incidences of malfunction, failure, and alarm conditions accompanied by recommended courses of action. It will also allow key holders to set and unset the alarm system using customer approved devices. For instance, personnel may have their own mobile phone configured onto the system as an entry/exit device allowing them access to the premises by using a password/number entered on their, and only their, phone. Access via an unauthorized phone is prohibited by the alarm control computer system 70, in one example, even though the correct pin may be used, thus ensuring security. Such communications can be customer configurable for either local (blue tooth etc) or remote, via the Internet link. Clients purchase an alarm monitoring contract tailored to suit their needs. For example, alarm reporting can be configured to report incidents to the police, a private security agency, neighbor, relative or the home owners own mobile device or cell phone, or any other person capable of investigating and correcting the alarm condition. A wide range of alarm monitoring contracts can be offered, for example, a pay as you go contract, or a fully contracted alarm monitoring and reporting service.

Other alternative may also be presented to the client or customer, for example, options for scaling the robustness of the security system. For instance, several Internet connected devices can be installed and configured to report alarm incidents ensuring that if one is disabled others will take over. In another example, alarm control, monitoring and reporting can be contracted to multiple service providers ensuring that if a connection to one service provider goes down protection is still afforded by the other contracted services (this is similar to having multiple control panels on the one site monitoring all the sensors). Further options include expandability of the system, for example, installing new devices. The operation for expanding the system includes the customer logging onto their Internet alarm system on the service providers web site via the Internet using a secure logon, and then adding the newly installed device Internet addresses to the system list. The system then checks and confirms the presence of the newly added device.

The customer then configures the devices onto their system with the help of the service providers' system configuration service. The service providers' web site may have a complete installation "wizard" removing the need for paper manuals and documentation. Further, using a PC on line it will provide manuals with 'click' keyword help, help pages, a glossary of terms, a click and drag configuration system, a test and commissioning system. An equivalent service will be provided for Internet connected (mobile) phones, which allows a customer not having access to a PC to use their mobile device instead. The installation wizard ensures that the customer visits all the recommended configuration options for the devices on their system and ensures that all tests for the specified and configured system are carried out.

Additionally, walk tests can be carried out using an appropriately authorized Internet connected device (mobile phone, portable computer, PDA, hand held computer, etc.) (an example of a walk test is found in commonly owned and co-pending U.S. patent application Ser. No. (12/015,679) which was incorporated by reference above) and may be organized with the help of the wizard for speed and efficiency with the shortest route and minimum amount of walking. Further, regarding the walk test, the installation and configuration service provides a site map and layout automatically upon commissioning a system. Alarm system software is centralized on the service providers web site(s), therefore software updates provided to them by the alarm company will be instantly available to all customers as soon as it is installed.

Thus, the security system of the present invention makes installation of alarm equipment simple for unskilled personnel, and with a cost savings as the central alarm panel does not have to be installed. The security system can be made as robust as the client desires by enabling several reporting paths, communications systems, in the form of Internet connections via several mobile phones, personal computers (PCs) and other Internet connected devices which are registered for the client's protected site. Reporting can be carried out to several alarm monitoring service providers if the customer so desires. In one embodiment of the invention, the hardware alarm devices must report their status to the service provider alarm configured system (SPACS) at regular intervals. The SPACS should also actively communicate with system components when required (i.e. if it has timed out on its report). The SPACS must react with appropriate responses to changes in alarm device status by reporting malfunctions, losses of communications, alarm conditions etc.

The security system of the present invention is an application of "Software as a Service" (SaaS). Traditionally alarm systems each have an expensive and sophisticated central control panel which requires skilled personnel to install and maintain. The monitoring or security system of the present invention does not have the traditional control panel. Instead it relies on a service provider running a central alarm control, monitoring and reporting system on a remote server which monitors and controls individual Internet connected alarm devices via suitable Internet links. The links provided includes inexpensive Internet connected devices such as mobile phones. Furthermore, a site manager managing the computer system or the user through the use of interactive software or a wizard software tool, will have the ability to reconfigure alarm reporting options quickly and remotely to suit their daily needs. For example, reporting of an alarm can be redirected to another phone or premises without referring to a manual. Additionally, updating the software on hundreds of customer panels is very time consuming and costly. Software updates on a Software as a Service (SaaS) control system is quick completed and available to all customers as soon as it is installed. Another option available with the present invention is offering dialogue for installation, test and maintenance procedures in full text and grammatical formats making it easier to understand instructions and messages. Further, fully annotated and detailed site maps may be constructed and stored in the computer system 70.

In one embodiment of the invention, zone sensors may be stand alone Internet connected devices, each with a unique Internet address's. Alternatively several discrete sensors may be connected to a zone multiplexer, which will be a stand alone Internet connected device. A protected site may have door contacts, bells, sounders, strobe lights, card readers and other actuators and sensors which may either be stand alone Internet connected devices, each with a unique Internet address, or connected together via a multiplexer which will be a stand alone Internet connected device. The protected site does not necessarily need a keypad. Keypad functionality can provided by a (mobile) phone, a PDA, a PC or possibly even by a TV remote control. This does not preclude a site having a dedicated Internet connected keypad being installed, however, an advantage of the present invention is that the fewer the number of individual devices that need to be installed the easier it is for unskilled personnel to install a system and the more affordable a system becomes. Furthermore, if the site keypads are the mobile phones of the occupiers, which are uniquely identifiable to the alarm system, then the system is made more secure when those keypads move off site with the keypad holder. All the devices are capable of communicating with the service providers web site either directly, by some form of modem, or indirectly via a wireless Internet connected gateway. To negate the possibility of wireless communications range problems all devices in the present embodiment are capable of relaying communications between devices and between a device and the gateway.

The service providers alarm control, monitoring and reporting web site using the computer system 70, allows creation of customer accounts. Each customer creates an account which allows him/her to use all the site facilities. All accounts are password protected. All communications for sensitive information is by secure network connection. The user access alarm system design pages with a graphical or textual front end, the design pages may be, for example, for mobile phones other for a PC, or a PDA. Additionally, the system allows entry of fantasy devices, which are proposed additions, not actually implemented at the time. A final design with fantasy devices may only be commissioned by warning of and then ignoring the presence or function of the fantasy devices. However, the customer can continue to develop their alarm system with fantasy devices and test it in emulation mode.

An example of creating a new protected site includes, the client registering site details with the service provider. This includes details of all Internet connected devices used for communications with the service provider (i.e., mobile phones, broadband links etc). It also includes Internet addresses of each and every active alarm system component on the protected premises. It can also include inactive alarm devices. The service provider checks for the presence of each active device as it is entered onto the system. The client is then prompted to configure the alarm system according to the customers' requirements and the devices ability. For instance a zone sensor may be configured for low sensitivity to prevent false alarms due to the presence of small animals. Configuration will allow the client to configure the alarm components function (i.e., entry/exit device with associated set and unset times, panic buttons, group membership (for part setting), etc.) just as can be done on traditional panel based systems. It also allows the client to name each sensor (e.g. Kitchen, Hall, Bedroom, etc.) and provide other subsidiary information ("shock sensor on south facing window" or "door locking mechanism for rear entrance", etc.). The advantages to this system are that the large amount of memory available on the server allows all annotation to be explicit. The availability of memory also means that an active help menu can be provided accompanied by a lot of textual and graphical prompting to make the process of configuring simpler. System expansion can be carried out quickly by activating and configuring pre-registered devices or by purchasing, registering and configuring a new device.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. A method for monitoring a specified area, comprising:

detecting predetermined events using sensors at a plurality of sites;

communicating with the sensors using a communications module at each site, each communications module transmitting an alert signal of the predetermined event using a communications system;

receiving the alert signal from each communications module using a remotely located computer system communicating with each communications module, the computer system having a computer program recorded on computer readable medium of the computer system;

dividing data logically and presenting the data about the sites being monitored using the computer program;

controlling the communications between the communications module and the computer system using the computer program for receiving transmissions from and sending transmissions to the communications module;

presenting specified monitoring options using the computer program; and communicating an alarm signal using the computer system after receiving the alert signal, wherein sending the transmissions to the communications module includes sending a data transmission with software and/or firmware to update the communications module.

2. The method of claim 1, further including:

communicating using the communications module simultaneously with multiple communication systems with the computer system.

3. The method of claim 1, further including:

generating logically a plurality of security zones using the computer system, each of the security zones being associated with a plurality of sensor devices.

4. The method of claim 1, further including:

providing an on-site interface for a user to send and receive data to and from the computer system for selecting configuration preferences for the sensors and an on-site security system.

5. The method of claim 4, further including:

selecting the monitoring options using the on-site interface.

6. The method of claim 1, wherein the monitoring options include alarm signal preferences.

7. The method of claim 1, wherein the monitoring options include a group of preferences comprising: alarm set-up, maintenance scheduling, and contract options.

8. The method of claim 1, wherein the monitoring options include a test mode option.

9. The method of claim 1, wherein the monitoring options include selecting multiple service providers.

10. The method of claim 1, wherein the monitoring options include emulating alarm system designs and selecting a preferred alarm system.

11. A computer program product comprising a computer readable medium having recorded thereon a computer program for enabling a processor in a computer system for monitoring a specified area, the computer program performing the steps of:

detecting predetermined events using sensors at a plurality of sites;

communicating with the sensors using a communications module at each site, each communications module transmitting an alert signal of the predetermined event using a communications system;

receiving the alert signal using a remotely located computer system communicating with the communications module, the computer system having a computer program recorded on computer readable medium of the computer system;

dividing data logically and presenting the data about the sites being monitored using the computer program;

controlling the communications between the transmitting device of the communications module and the computer system for receiving transmissions from and sending transmissions to the communications module using the computer program;

offering specified monitoring options using the computer program; and communicating an alarm signal using the computer system after receiving the alert signal, wherein sending the transmissions to the communications module includes sending a data transmission with software and/or firmware to update the communications module.

* * * * *